US005323873A

United States Patent [19]

Pelofi

[11] Patent Number: 5,323,873

[45] Date of Patent: Jun. 28, 1994

[54] SAFETY DEVICE

[75] Inventor: Pierre-Georges Pelofi, Bourges, France

[73] Assignee: Societe Anonyme Dite: Komet, Vierzon, France

[21] Appl. No.: 28,189

[22] Filed: Mar. 9, 1993

[30] Foreign Application Priority Data

Mar. 18, 1992 [FR] France ..... 92 03234

[51] Int. Cl.[5] ..... A62B 35/04

[52] U.S. Cl. ..... 182/4; 182/5; 182/192; 188/65.1

[58] Field of Search ..... 182/4–7, 182/191–193, 234; 188/65.1–65.5

[56] References Cited

U.S. PATENT DOCUMENTS 4,371,127 2/1983 Shimogawa ..... 188/65.4
4,521,000 6/1985 Dodge, Jr. ..... 182/5 X
4,923,037 5/1990 Stephenson et al. .

FOREIGN PATENT DOCUMENTS 2617050 12/1988 France .
2637505 4/1990 France .
9100121 1/1991 World Int. Prop. O. .

OTHER PUBLICATIONS

French Search Report and Annex.

*Primary Examiner*—Alvin C. Chin-Shue
*Attorney, Agent, or Firm*—Sandler Greenblum & Bernstein

[57] ABSTRACT

A safety device comprises a body delimiting a passage having a safety rope passed through it, a ring connected by a strap to a belt, a brake and a system for locking the device to the rope should the worker fall. The device comprises a transverse spindle on which a toothed wheel is a relatively tight fit to constitute said brake, a cam mounted on the spindle and having teeth to cooperate with the safety rope and a weight cooperating with a pawl held away from a toothed ring attached to the cam by a spring, the weight being mounted in such a way that if the toothed wheel rotates at a speed greater than a specific threshold it causes engagement of the pawl with the toothed ring so that the cam teeth lock the safety rope into the passage.

6 Claims, 5 Drawing Sheets

10
2
50
51
52
11
12
1
6
4

1
2
3
7
8
15
4

10
51
52
11
12
8
7
6
5
4

SAFETY DEVICE

BACKGROUND OF THE INVENTION

1. Field of the Invention

The invention concerns safety devices for persons working at a great height.

The invention concerns devices which are movable along a safety rope running vertically up a wall of a building, a tower or a pylon.

2. Description of the Prior Art

These devices comprise a body having a passage through which the safety rope passes, a brake cooperating with the rope and a ring connected by a strap to a belt or a harness worn by the worker, said ring being combined with a system designed to lock the device onto the rope should the worker fall.

The ring is usually connected to a cam which wedges the safety rope against the opposite side of the passage if the traction force on the ring exceeds a particular value.

These devices are very well known and are totally effective. They do have some drawbacks, however. They must be mounted on the safety rope in a particular orientation because they work in only one direction and if the worker falls they lock up instantaneously, which may cause injury.

One object of the present invention is to remedy these drawbacks.

SUMMARY OF THE INVENTION

The present invention consists in a safety device comprising a body having two flanges delimiting a passage adapted to have a safety rope passed through it, said safety rope running vertically along a building or the like, a ring adapted to be connected by a strap to a belt or a harness worn by a worker, a brake adapted to cooperate with said safety rope to prevent said device sliding along said rope and means for locking said device to said rope should the worker fall, whereby said flanges are joined by a transverse spindle on which a toothed wheel is a relatively tight fit, said toothed wheel being adapted to cooperate with said safety rope to constitute said brake, a cam mounted on said spindle and having teeth adapted to cooperate with said safety rope and being urged into a position away from said rope by a spring, a weight mounted on said spindle cooperating with a pawl held away from a toothed ring attached to said cam by a spring, and said weight being mounted in such a way that if said toothed wheel rotates at a speed greater than a specific threshold it causes engagement of said pawl with said toothed ring so that said cam is rotated and said teeth lock said safety rope into said passage.

This device is of simple design, secure in operation and functions progressively.

The device preferably comprises two cams each having a toothed ring, two weights disposed one on each side of said toothed wheel and two pawls adapted to cooperate with respective toothed rings having oppositely directed teeth, said pawls being also oppositely directed and said ring being movable in a slot in said flanges so that it can be selectively disposed adjacent either end of said device.

The device is therefore easier to fit to the rope because it can be fitted in either of two orientations at 180° to each other.

The cam preferably incorporates a sector-shape slot coaxial with said spindle and in which move fingers cooperating with the ends of a torsion spring wound around said spindle and adapted to urge said fingers against respective ends of said slot.

A pin is preferably attached to and projects from both sides of said toothed wheel, said pawls can preferably pivot on said pin and said springs holding said pawls away from said toothed rings are preferably carried by pins attached to said toothed wheel and constituting abutments for said weights.

The toothed wheel is preferably keyed to a ring rotatably mounted on said spindle and on which said weights are mounted.

The flanges are preferably hinged together and said spindle is preferably attached to one flange and is hollow and internally screwthreaded to cooperate with a threaded rod for fastening said two flanges together.

One specific embodiment of the invention will now be described in more detail by way of example only and with reference to the appended drawings.

DETAILED DESCRIPTION OF THE INVENTION

Figures 1, 2, 3:
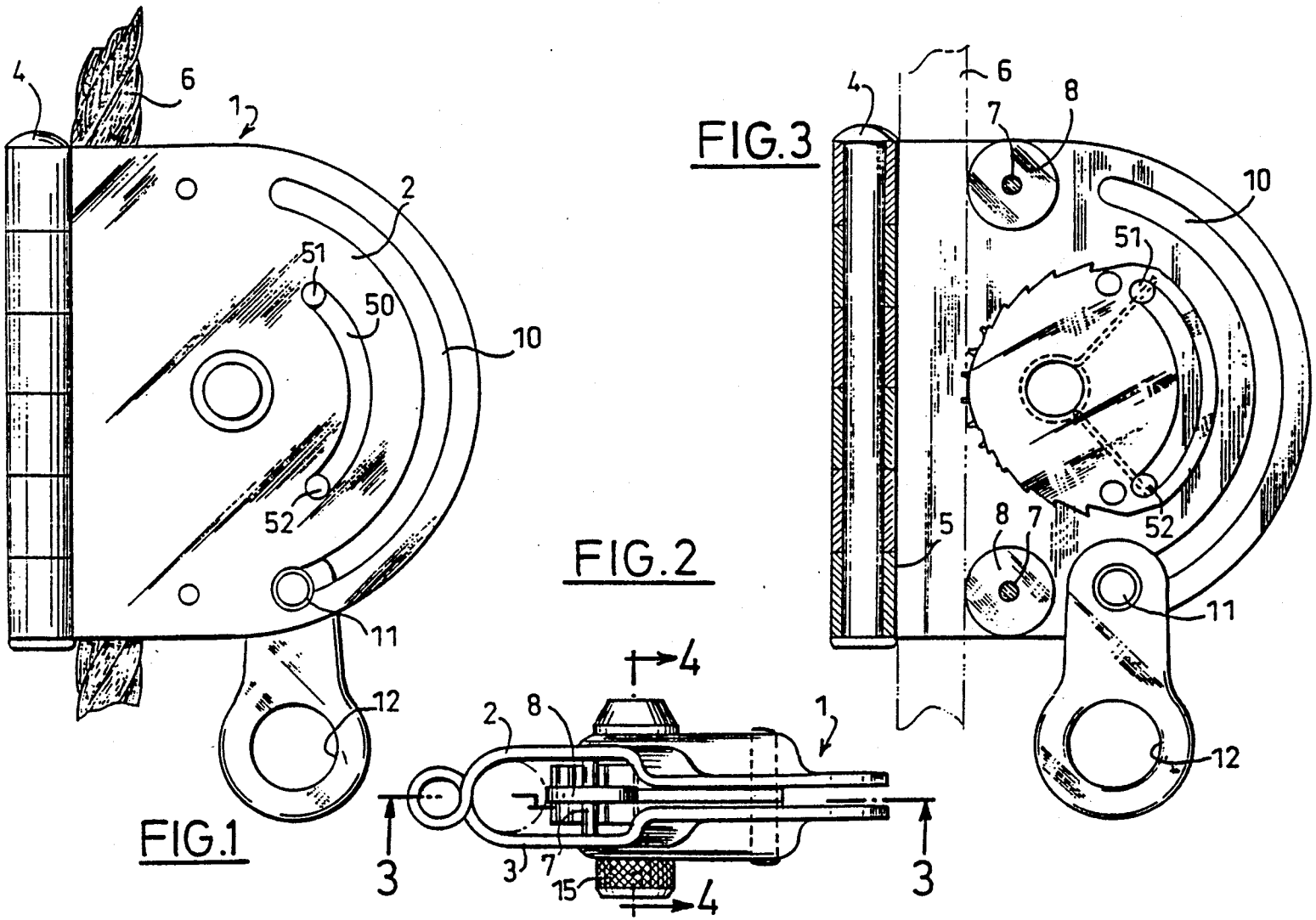
FIG. 1 is a view in elevation of a device in accordance with the invention.
FIG. 2 is a plan view of the device from FIG. 1.
FIG. 3 is a view in cross-section on the line 3—3 in FIG. 2.
Figure 5:
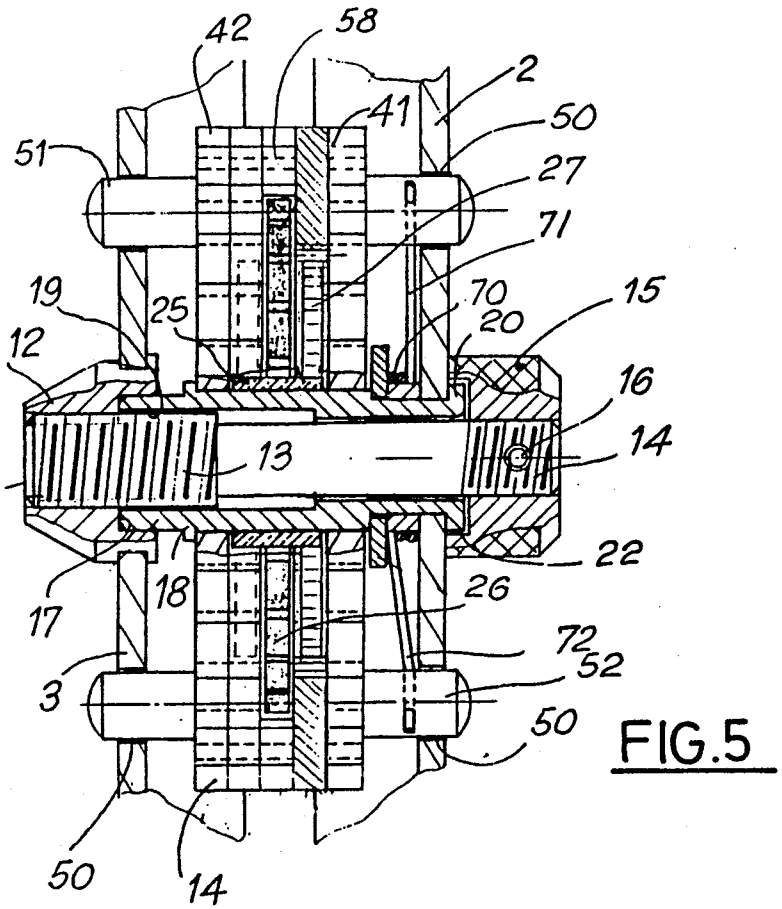
FIG. 5 shows part of FIG. 4 in cross-section and to a larger scale.
Figure 4:
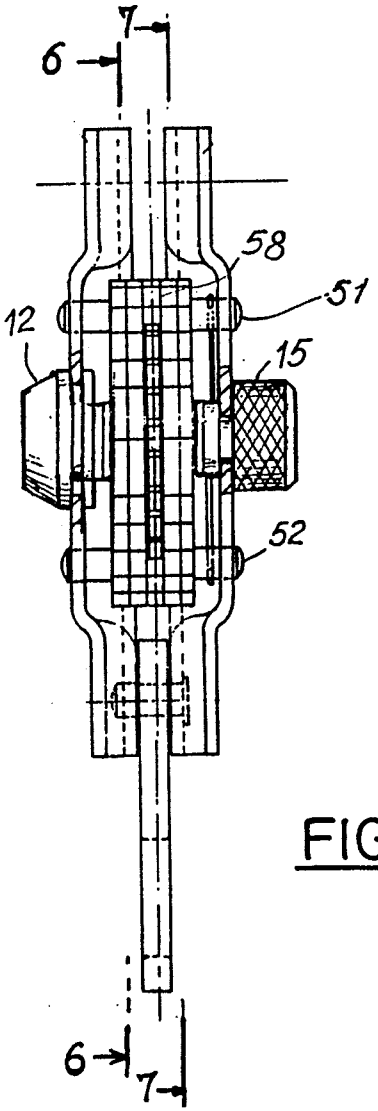
FIG. 4 a view in cross-section on the line 4–4 in FIG. 2.
Figure 7:
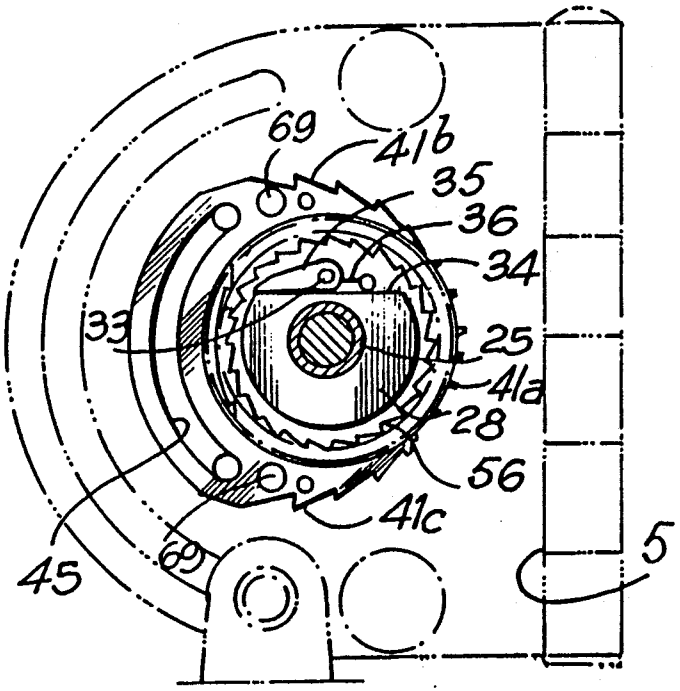
FIG. 7 a view in cross-section on the line 7—7 in FIG. 4.
Figure 6:
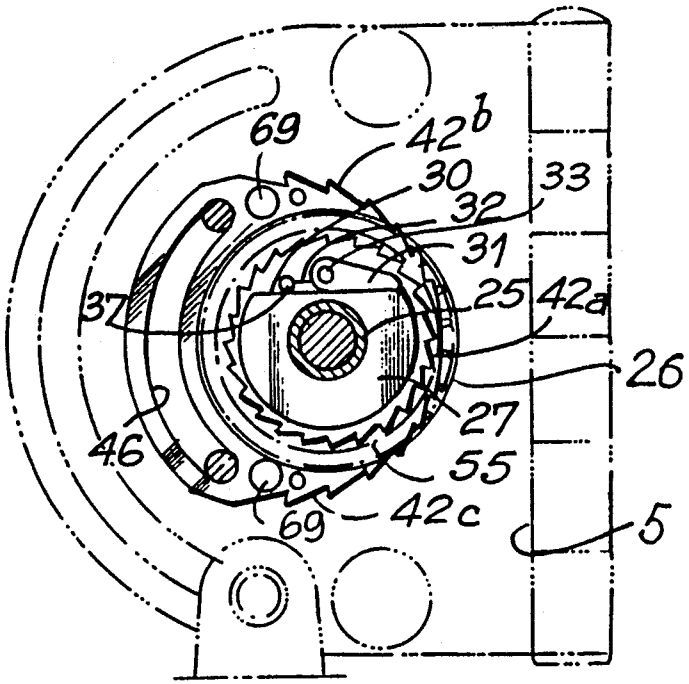
FIG. 6 is a view in cross-section on the line 6—6 in FIG. 4.
Figure 8:
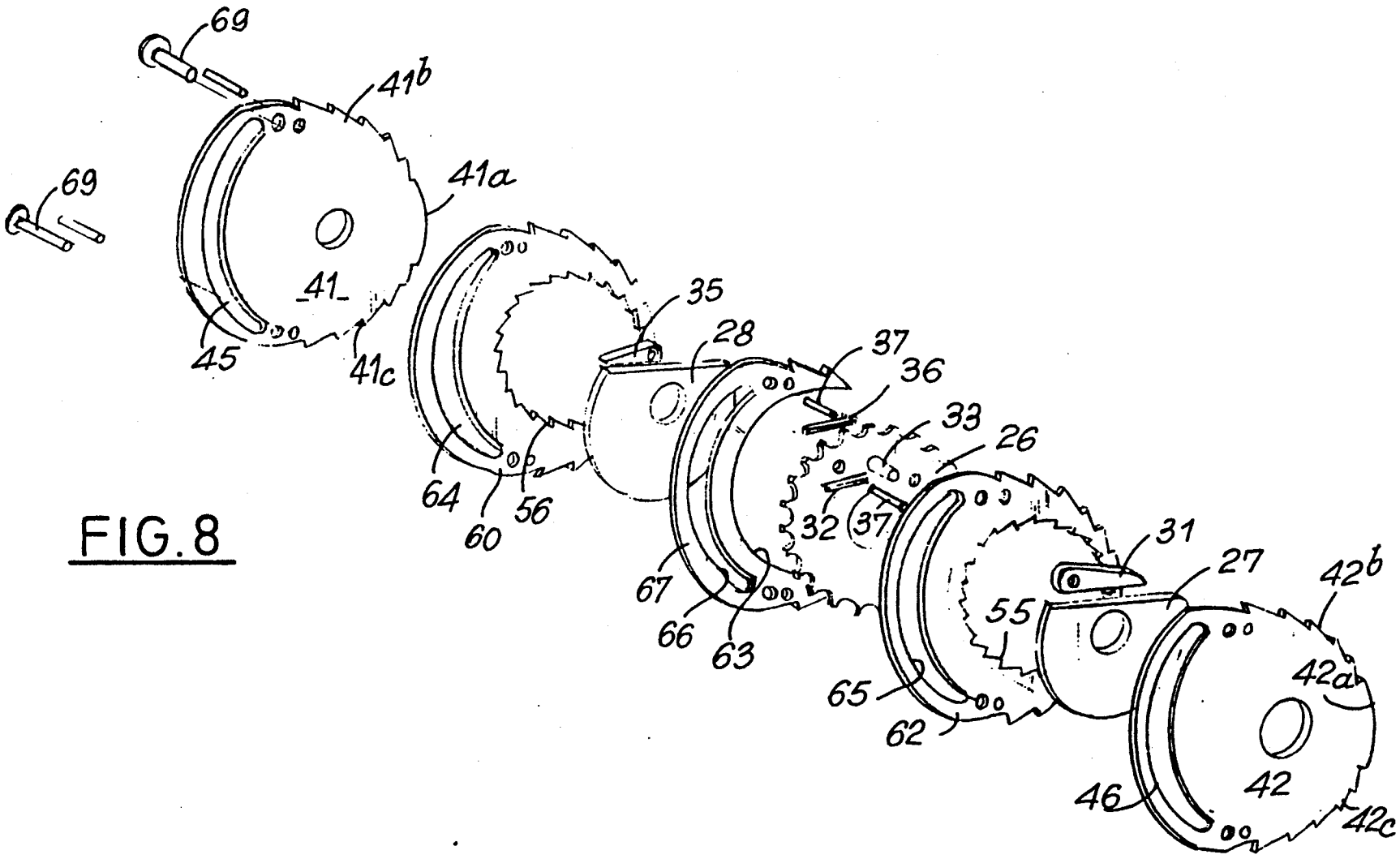
FIG. 8 is an exploded perspective view of a locking system.

The device shown in the figures comprises a body 1 made up of two flanges 2 and 3 hinged together by a hinge 4 and delimiting a passage through which a safety rope 6 passes.

The flanges support two pins 7 on which rotate rollers 8 which press the rope 7 against the opposite side of the passage 5.

On the side opposite the passage the flanges comprise a sector-shape slot 10 which guides a pin 11 attached to a ring 12.

The flange 3 carries a rotatably mounted nut 12 into which is screwed a first part 13 of a threaded rod which has a second threaded part 14 of smaller diameter onto which is screwed a nut 15 which bears against the flange 2. A safety pin 16 is inserted in aligned diametral holes in the nut 15 and the threaded rod 14.

The nut 12 includes a housing 17 into which is received the end of a sleeve 18 which has a screwthread 19 into which the first part of the threaded rod is screwed. The free end of the sleeve 18 includes a shoulder 20 bearing against the flange 2 and accommodated in a groove 22 on the respective side of the nut 15.

To a ring 25 which is a moderately tight fit on the sleeve 18 is keyed a toothed wheel 26 cooperating with the safety rope 6 and constituting a brake so that the device does not to tend to slide along said rope under its own weight.

Two weights 27 and 28 are a moderately tight fit on the ring 25, one on each side of the toothed wheel 26. The weight 27 has a flat 30 against which bears a pawl 31 hinged to a pin 33 attached to the toothed wheel 26 where it projects from the respective side thereof, said pawl being pressed against said flat by a spring 32.

The weight 28 has a flat 34 against which a pawl 35 hinged on the pin 33 where it projects from the opposite side of the toothed wheel 25 is pressed by a spring 36. The springs 32 and 36 are retained by pins 37 attached to the toothed wheel 26.

A device 40 for locking up the device is mounted on the sleeve 18.

The device 40 comprises two cam 41 and 42. On the side facing the passage 5 the cam 41 has a smooth part 41*a* and teeth 41*b* and 41*c* symmetrical to a horizontal plane passing through the threaded rod 13. The part opposite the smooth part 41 incorporates a sector-shaped slot 45. A member 60 comprising a circular opening in which teeth 56 are formed to constitute a toothed ring is fixed to the side of the cam 41 facing towards the toothed wheel 26. The cam 42 is of the same design as the cam 41 and has a smooth part 42*a*, teeth 42*b* and 42*c* and a slot 46. A member 62 incorporating a circular opening in which teeth 55 are formed to constitute a toothed ring is fixed to the side of the cam 42 facing towards the toothed wheel 26. A spacer 57 is inserted between the members 60 and 62 and has a circular notch 63 facing the toothed wheel 26. The members 60, 62 and 67 have respective slots 64, 65 and 66 aligned with the slots 45 and 46. The member 60 and 62 are cams corresponding to the cams 41 and 42. The cams 41 and 42 and the members 60, 62 and 67 are assembled together by rivets 69 passed through respective holes in said members.

Each flange 2 and 3 comprises a slot 50 aligned with the slots 45 and 46.

Fingers 51 and 52 are inserted in the various slots 45, 46, 50, 64, 65 and 66. The finger 51 is urged by a respective end 71 of a torsion spring 70 wound around the sleeve 18 against one end of said slots. The other end 72 of said spring 70 urges the pin 52 against the other end of the slots 45, 46, 50, 64, 65 and 66.

The cams 41 and 42 are thus held in equilibrium with the smooth parts 41*a* and 42*a* facing the passage 5.

the teeth of the toothed rings 55 and 56 are oppositely directed and the pawls 31 and 35 are also oppositely directed.

The weights can pivot in only one direction because in the opposite direction the flat abuts on the pin 37.

The device operates as follows:

The person working at a great height wears a belt or a harness joined to a strap at the free end of which is a safety hook fixed to the ring 12.

Referring to FIG. 3, the toothed wheel 26 cooperates with the safety rope 6 and constitutes a brake preventing the device sliding freely along said rope 6.

As the worker moves up and down, the device moves freely along the safety rope 6, the wheel 26 turning and its teeth cooperating with said rope Provided that the toothed wheel 26 moves slowly the weights 27 and 28 are entrained in the direction of rotation of the toothed wheel 26.

Figure 10:
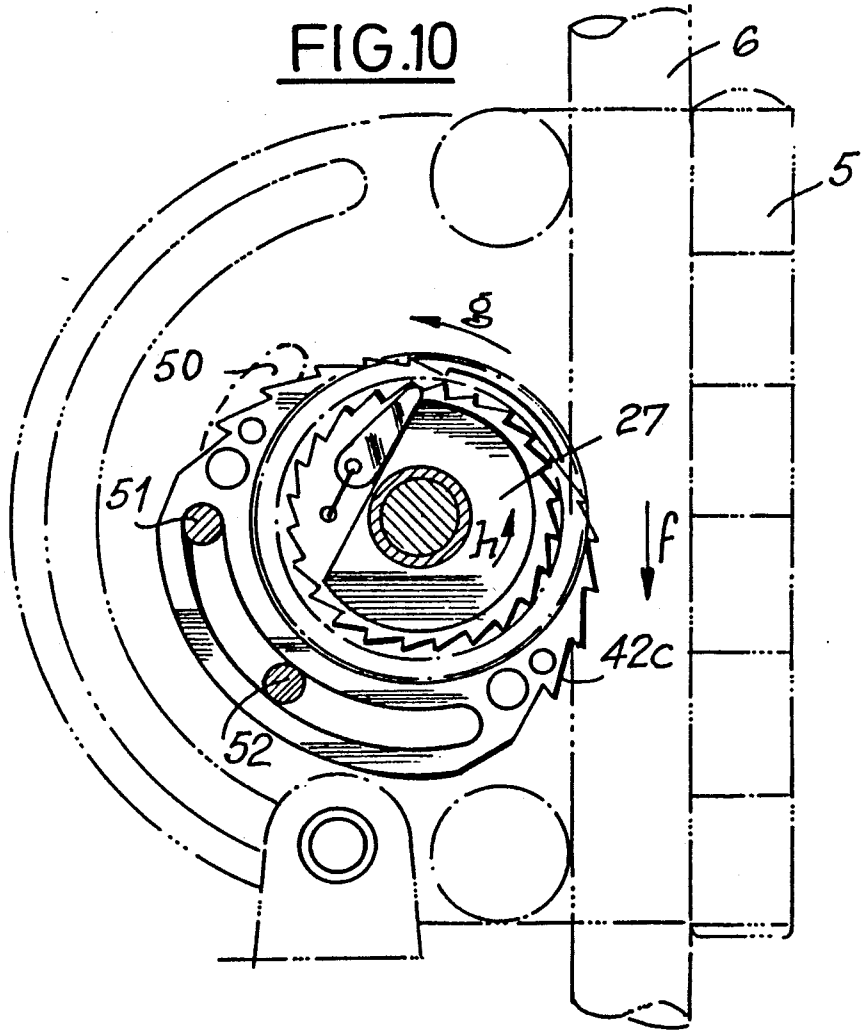
FIGS. 9 and 10 are views in cross-section relating to FIG. 7 and showing different phases of operation.
Figure 9:
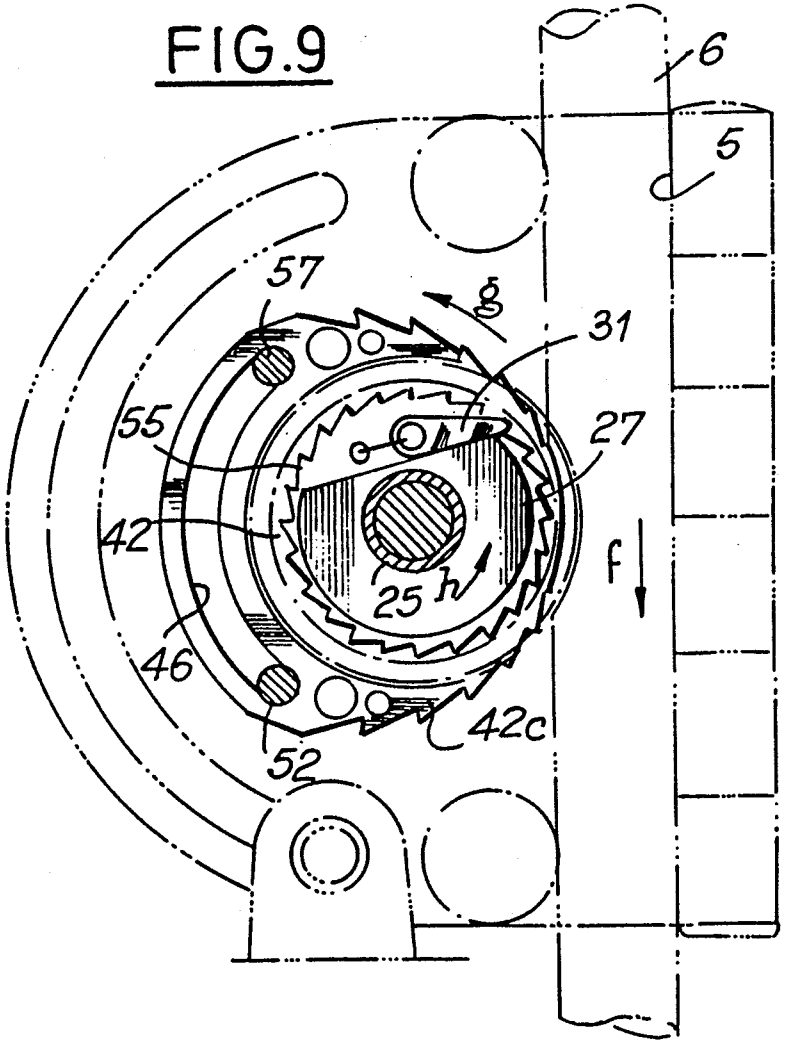

Referring now to FIG. 9, should the worker fall the device moves along the safety rope in the direction of the arrow f. The toothed wheel 26 is rotated at high speed so that the weight 27, opposing the action of the spring 32, pivots the pawl 31 which engages in a tooth of the ring 55 with the result that the cams 41 and 42 are driven in the direction of the arrow g against the action of the branch 71 of the spring 70 as the finger 51 is abutted against the respective end of the slot 46. The teeth 42*c* then bite into the safety rope 6 to lock the safety device to the rope (see FIG. 10).

Referring to FIG. 9, the teeth 42*c* diverge from the ring 25 in the direction from the smooth part 42*a* towards the slot 46 so that the stronger the downward force the more securely is the safety device locked to the safety rope 6.

All that is necessary to release the device is to move it in the direction opposite to the arrow whereupon the spring 70 returns the cams 41 and 42 to their original position.

The locking of the safety device to the safety rope is relatively progressive.

If the device is fitted to the rope the other way around the operation is exactly the same except that in this case it is the pawl 35 which cooperates with the ring 56 to cause the device to be locked up, the pin 11 sliding to the other end of the sector 10 so that the ring is at the bottom.

The device is extremely simple to fit to the safety rope 6 as all that is required is to remove the threaded rod 13 in order to move the flanges 2 and 3 apart by means of the hinge 4.

Because the device operates in either direction, it can be mounted on the safety rope 6 without any particular precautions.

Of course, the invention is not limited to the embodiment described and shown. Numerous modifications of detail may be made thereto without departing from the scope of the invention.

There is claimed:

1. Safety device comprising a body having two flanges delimiting a passage adapted to have a safety rope passed through it, said safety rope running vertically along a building or the like, a ring adapted to be connected by a strap to a belt or a harness worn by a worker, a brake adapted to cooperate with said safety rope to prevent said device sliding along said rope and means for locking said device to said rope should the worker fall, in which device said flanges are joined by a transverse spindle on which a toothed wheel is a relatively tight fit, said toothed wheel being adapted to cooperate with said safety rope to constitute said brake, a cam mounted on said spindle having teeth adapted to cooperate with said safety rope and being urged into a position away from said rope by a spring, a weight mounted on said spindle cooperating with a pawl held away from a toothed ring attached to said cam by a spring, and said weight being mounted in such a way that if said toothed wheel rotates at a speed greater than a specific threshold it causes engagement of said pawl with said toothed ring so that said cam is rotated and said teeth lock said safety rope into said passage.

2. Device according to claim 1 wherein two cams each have a toothed ring, two weights are disposed one on each side of said toothed wheel and two pawls are adapted to cooperate with respective toothed rings having opposite directly teeth, said pawls being also oppositely directed and said ring being movable in a slot in said flanges so that it can be selectively disposed adjacent either end of said device.

3. Device according to claim 1 wherein said cam incorporates a sector-shape slot coaxial with said spindle and in which move fingers cooperating with the ends of a torsion spring wound around said spindle and adapted to urge said fingers against respective ends of said slot.

4. Device according to claim 2 wherein a pin is attached to and projects from both sides of said toothed wheel, said pawls can pivot on said pin and said springs holding said pawls away from said toothed rings are carried by pins attached to said toothed wheel and constituting abutments for said weights.

5. Device according to claim 2 wherein said toothed wheel is keyed to a ring rotatably mounted on said spindle and on which said weights are mounted.

6. Device according to claim 1 wherein said flanges are hinged together and said spindle is attached to one flange and is hollow and internally screwthreaded to cooperate with a threaded rod for fastening said two flanges together.

* * * * *